US008257101B2

(12) United States Patent
Ichio

(10) Patent No.: US 8,257,101 B2
(45) Date of Patent: Sep. 4, 2012

(54) VEHICLE-SIDE CONNECTOR

(75) Inventor: Toshifumi Ichio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/106,974

(22) Filed: May 13, 2011

(65) Prior Publication Data

US 2011/0287667 A1 Nov. 24, 2011

(30) Foreign Application Priority Data

May 24, 2010 (JP) ..... 2010-118486

(51) Int. Cl.
*H01R 4/64* (2006.01)

(52) U.S. Cl. ..... 439/206; 439/559

(58) Field of Classification Search ..... 439/206, 439/205, 208, 559
See application file for complete search history.

(56) References Cited

U.S. PATENT DOCUMENTS

| | | | | |
|---|---|---|---|---|
| 4,534,609 | A | 8/1985 | White | |
| 5,310,364 | A * | 5/1994 | Hooper et al. | 439/724 |
| 5,593,320 | A | 1/1997 | Konda et al. | |
| 5,769,648 | A * | 6/1998 | Hayashi | 439/206 |

FOREIGN PATENT DOCUMENTS

| | | |
|---|---|---|
| EP | 1261072 | 11/2002 |
| GB | 2281154 | 2/1995 |
| WO | 2009156800 | 12/2009 |

* cited by examiner

*Primary Examiner* — Phuong Dinh
(74) *Attorney, Agent, or Firm* — Gerald E. Hespos; Michael J. Porco

(57) ABSTRACT

A vehicle-side connector (10) has a housing (20) to which a charging connector is connectable. A terminal accommodating portion (22) is provided in the housing (20) and includes terminal accommodating holes (H1) for accommodating vehicle-side terminal fittings (30) that are connectable to charging terminals in the charging connector. A retainer (40) including a partition wall (45) is inserted between two adjacent terminal accommodating holes (H1), and is mounted onto the outer periphery of the terminal accommodating portion (22) from behind. Drainage holes (24) are formed at sides of peripheral parts of inner walls of the terminal accommodating holes (H1) distant from the partition wall (45), and water guides (26) slope down from the peripheral edges of the first drainage holes (24) toward the outer periphery of the terminal accommodating portion (22).

13 Claims, 23 Drawing Sheets

VEHICLE-SIDE CONNECTOR

BACKGROUND OF THE INVENTION

1. Field of the Invention

The invention relates to a vehicle-side connector to be connected to a charging connector at the time of charging.

2. Description of the Related Art

U.S. Pat. No. 5,593,320 discloses a vehicle-side connector to be connected to a charging connector. This vehicle-side connector includes a housing internally formed with cavities for accommodating terminal fittings. Waterproof seals are interposed between the inner peripheries of the cavities and the outer peripheries of the terminal fittings. The waterproof seals prevent penetration of water retained in clearances between the cavities and the terminal fittings into a vehicle side. However, air retained between the two connectors cannot escape easily to the outside at the time of connecting the mating charging connector to the vehicle-side connector, and a large connecting force is necessary. Additionally, the trapped air pushes the waterproof seals back to form clearances between the cavities and the terminal fittings and water may enter the vehicle side through these clearances.

The invention was developed in view of the above situation and an object thereof is to prevent penetration of water into a vehicle side while removing air at the time of connecting two connectors.

SUMMARY OF THE INVENTION

The invention relates to a vehicle-side connector to be connected to a charging connector at the time of charging. The vehicle-side connector includes a housing with a front end to which the charging connector is connectable. A terminal accommodating portion is provided in the housing and includes terminal accommodating holes for accommodating terminal fittings that are connectable to charging terminals in the charging connector. At least one partition wall is provided between a pair of adjacent terminal accommodating holes. At least one first drainage hole is formed at peripheral parts of inner walls of the terminal accommodating holes distant from the partition wall. At least one water guide is formed and slopes down from the peripheral edges of the first drainage hole toward the outer periphery of the terminal accommodating portion.

The at least one partition wall may be provided in or on a retainer to be mounted onto the outer periphery of the terminal accommodating portion.

According to this construction, air retained between the two connectors can escape to the outside through the first drainage holes when the charging connector is connected to the vehicle-side connector at the time of charging. Thus, a small connecting force is sufficient. Further, a grommet can be mounted to cover the terminal accommodating portion so that water retained between the two connectors is guided into the grommet through the first drainage holes, the water guiding portions and the outer periphery of the terminal accommodating portion and discharged to the outside of a vehicle through an escaping hole formed in the grommet. Thus, water penetration into the vehicle can be prevented while air is removed at the time of connecting the two connectors.

The partition wall preferably is inserted between the two adjacent terminal accommodating holes and reliably prevents a short circuit between the terminal fittings in the two terminal accommodating holes. On the other hand, a partition wall could block a discharge path toward the partition wall and water easily could be retained in the terminal accommodating holes. To avoid this problem, the first drainage holes preferably are formed at peripheral parts of the inner walls of the terminal accommodating holes distant from the partition wall. However, a grommet can be mounted to cover the terminal accommodating portion. Thus, water retained in the terminal accommodating holes can be discharged into the grommet via the water guides through the first drainage holes.

The terminal accommodating portion may include front and rear projections that project forward and rearward of the housing. Partition walls at least partly partition the terminal accommodating holes into front and rear sections. Second drainage holes may penetrate through the partition walls in substantially forward and backward directions. The first drainage holes may be formed in a peripheral wall of the rear projection. According to this construction, water retained in the front projection can be discharged into the rear projection through the second drainage holes and further discharged to the water guides through the first drainage holes.

Each terminal fitting may include at least one flange to be brought into contact with the rear surface of the partition wall.

The inner wall of each terminal accommodating hole in the rear projection may be recessed to form at least one bypass groove that can discharge water backward from the second drainage hole while bypassing the flange.

According to this construction, water retained in the front projection can be discharged backward via the bypass grooves through the second drainage holes.

The retainer may include a plurality of mounting pieces to be mounted on the outer periphery of the rear projection.

At least one clearance which may be formed substantially in a circumferential direction between the mounting pieces and the outer periphery of the rear projection to allow passage of water. A grommet can be mounted to cover the terminal accommodating portion. Water discharged to the outer periphery of the terminal accommodating portion from the water guides can be discharged into the grommet through the clearance.

The bypass groove may be formed in an area overlapping the second drainage holes substantially in radial directions of the terminal accommodating holes.

The retainer may include a base and mounting pieces to be mounted on the terminal accommodating portion.

Cutout holes may be formed in a range from the base to the mounting pieces to allow introduction of one or more wires connected to the terminal fittings to the base. The wires may be arranged radially inwardly of the cutout holes.

Mounting pieces may be arranged intermittently along the outer peripheral surface of the base.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE DRAWINGS

DETAILED DESCRIPTION OF THE PREFERRED EMBODIMENTS

Figure 1:
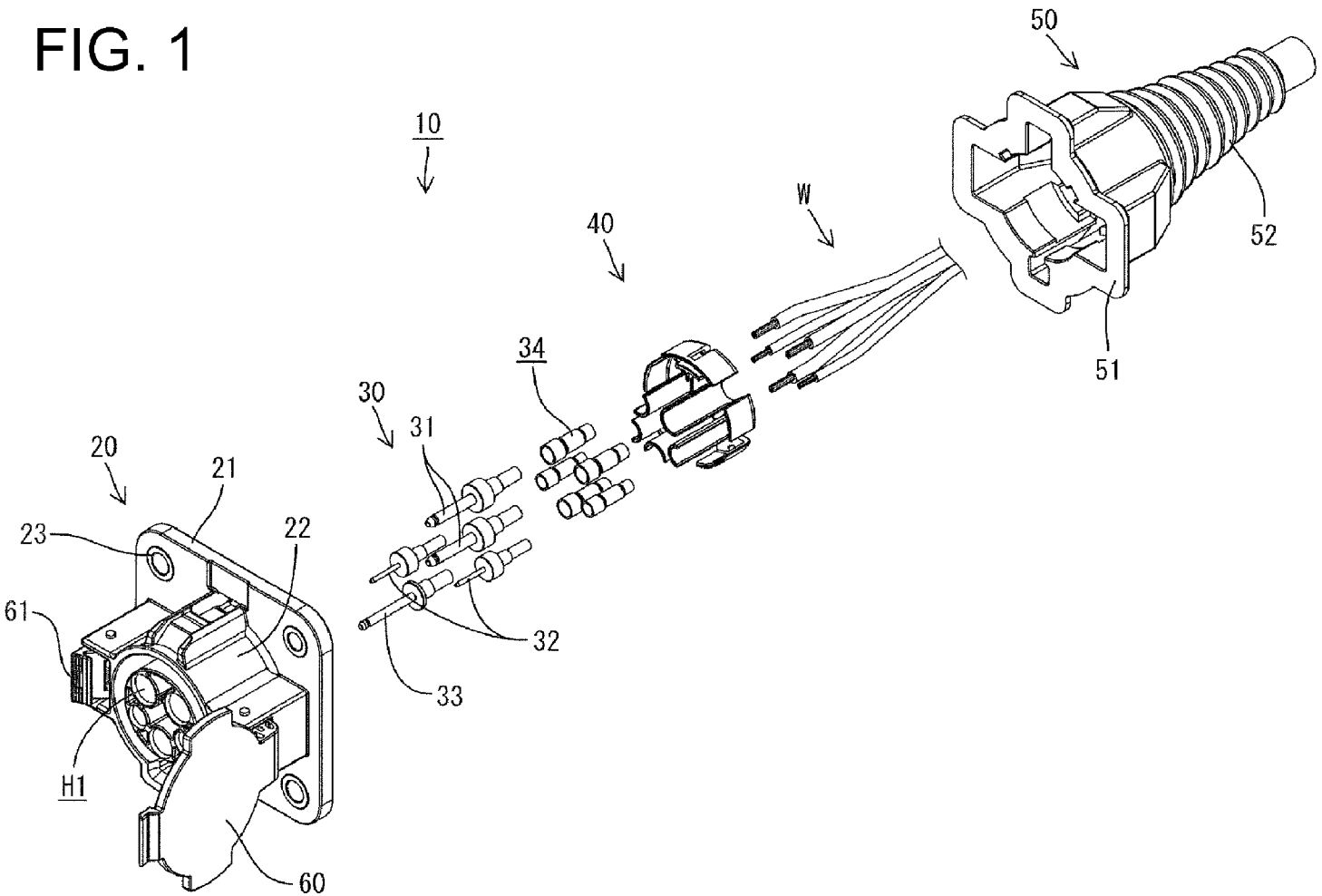
FIG. 1 is an exploded perspective view of a vehicle-side connector according to one embodiment.

A vehicle-side connector in accordance with the invention is identified by the numeral 10 in FIG. 1 and includes a housing 20, vehicle-side terminals 30, a retainer 40 and a grommet 50. The vehicle-side connector 10 is to be fixed to a body (not shown) of a vehicle and a charging connector (not shown) arranged outside the vehicle is connectable to the housing 20 from the front.

The vehicle-side terminals 30 include two power terminals 31, two signal terminals 32 and a ground terminal 33. Each vehicle-side terminal 30 includes a wire connecting portion 30A. Wires W are connected electrically conductively to the power terminals 31 and are connected to a vehicle-side battery (not shown). Thus, charging is possible by electrically connecting the charging connector to the vehicle-side connector 10. On the other hand, round pin-shaped terminal connecting portions 30C project before to the wire connecting portions 30A. A flange 30B bulges radially out between the wire connecting portion 30A and the terminal connecting portion 30C. A shrinkable tube 34 is mounted in an area from the wire connecting portion 30A to a coating of the wire W and makes the interior of the wire connecting portion 30A fluid- or watertight.

The housing 20 is made e.g. of synthetic resin and includes a mounting portion 21 in the form of a substantially rectangular flat plate and a cylindrical terminal accommodating portion 22 penetrates through the mounting portion 21 in substantially forward and backward directions. Collars 23 are provided at (e.g. four) corners of the mounting portion 21 by insert molding. The housing 20 is to be fixed to the body by inserting bolts (not shown) into the collars 23 and screwing them into bolt holes formed in the body.

Figure 2:
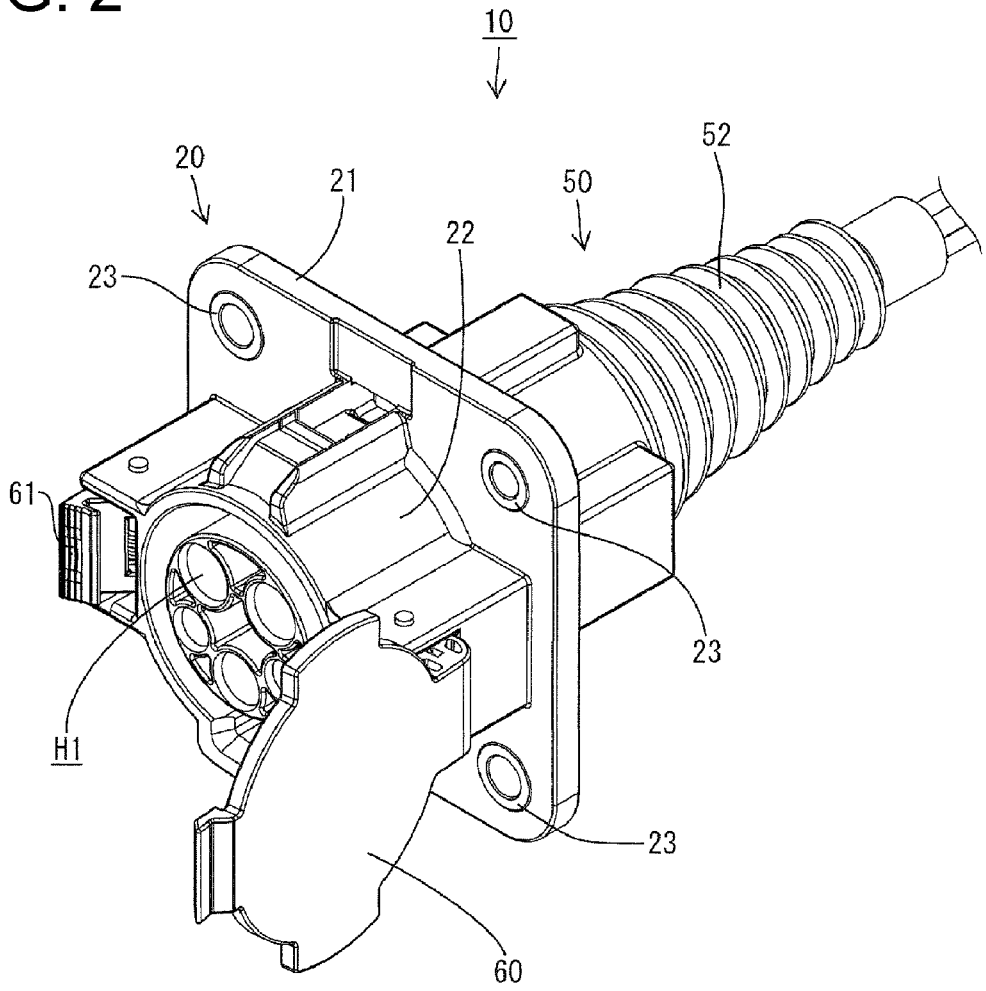
FIG. 2 is a perspective view of a vehicle-side connector in which a water-stop cap is at an open position.
Figure 3:
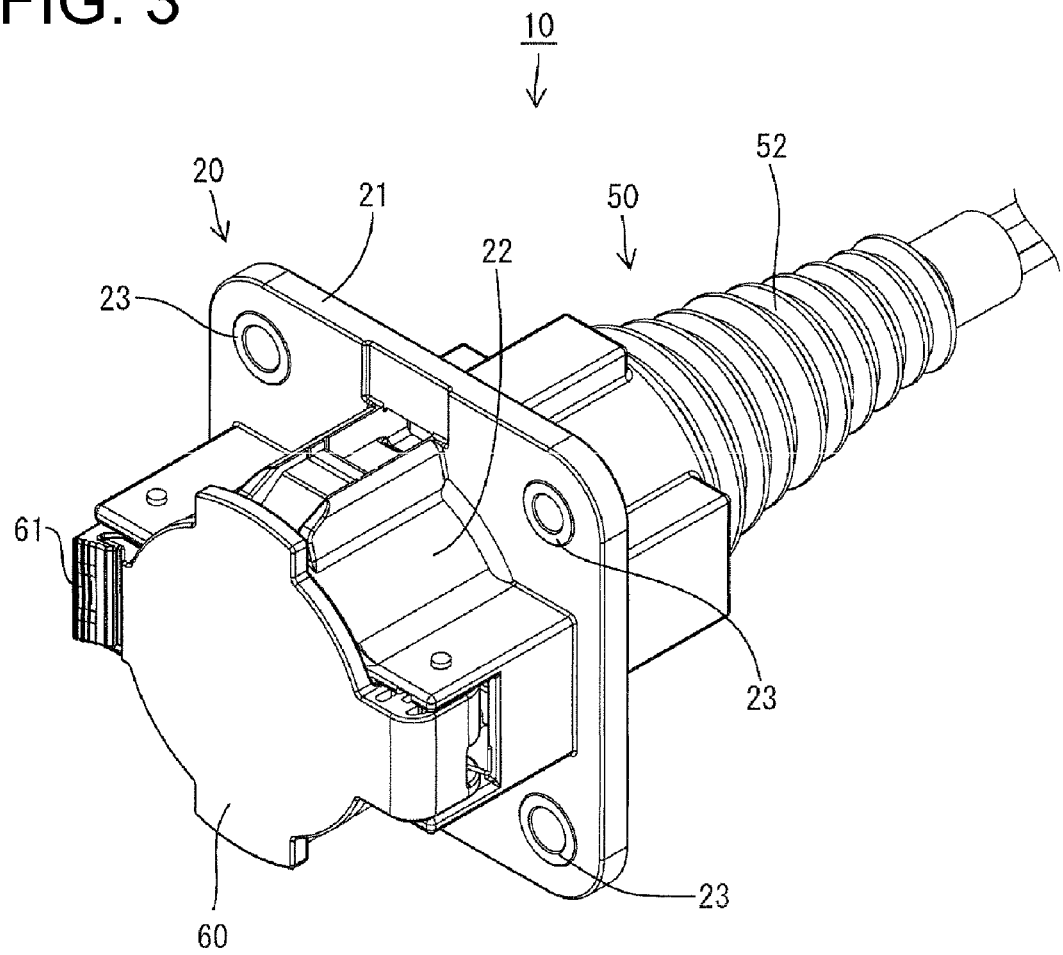
FIG. 3 is a perspective view of the vehicle-side connector in which the water-stop cap is at a closed position.
Figure 4:
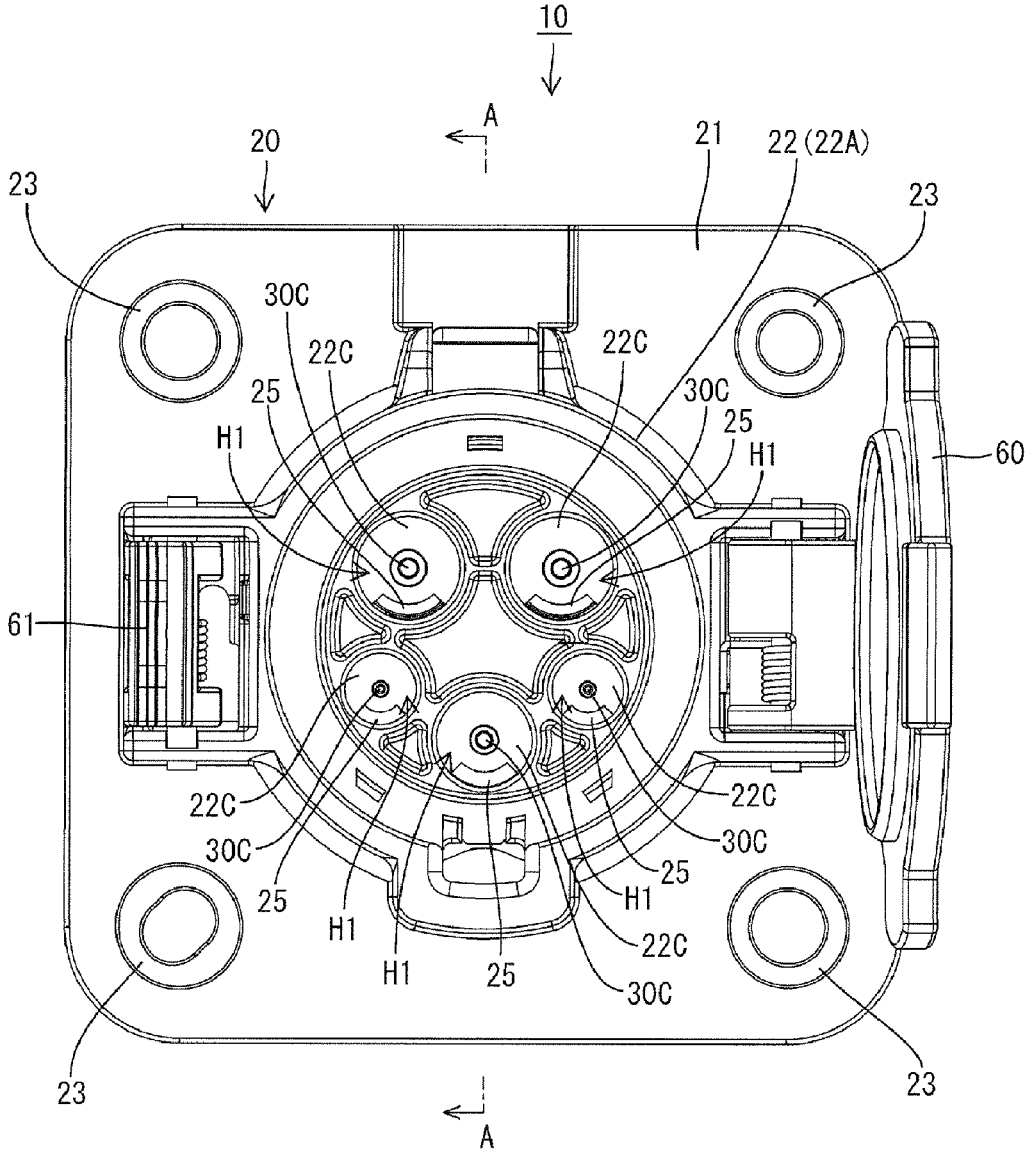
FIG. 4 is a front view of the vehicle-side connector in which the water-stop cap is at the closed position.
Figure 17:
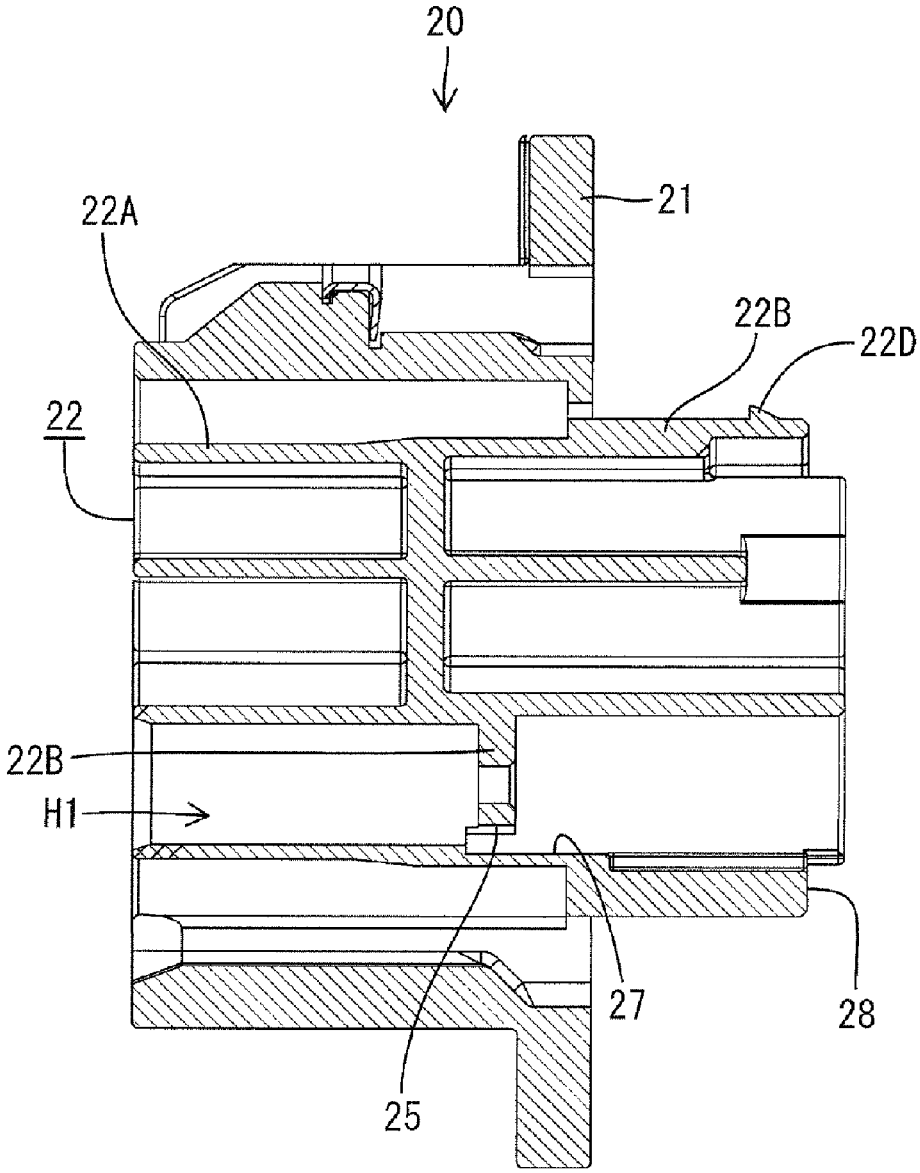
FIG. 17 is a section along H-H in FIG. 16.

As shown in FIG. 17, the terminal accommodating portion 22 includes a front projection 22A that projects forward of the mounting portion 21 and a rear projection 22B that projects backward of the mounting portion 21. A water-stop cap 60 is openably and closably attached to a front end opening of the front projection 22A. The water-stop cap 60 is swingable between an open position shown in FIG. 2 and a closed position shown in FIG. 3. A hook 61 for holding the water-stop cap 60 at the closed position is provided near an end of the front end opening of the front projection 22A opposite to a mounted part of the water-stop cap 60.

Terminal accommodating holes H1 penetrate through the terminal accommodating portion 22 in forward and backward directions. At the closed position, the water-stop cap 60 is closed to seal the front end opening of the front projection 22A. Therefore the interiors of the terminal accommodating holes H1 are made fluid- or watertight. On the other hand, the water-stop cap 60 is released at the open position at the time of charging and water may enter the interiors of the terminal accommodating holes H1. When the charging connector in a wet state is fit into the front end opening of the front projection 22A, water or other fluid may enter the interiors of the terminal accommodating holes H1. Accordingly, the water or liquid having entered the interiors of the terminal accommodating holes H1 needs to be discharged to the outside of the vehicle. This drainage structure is described in detail later.

Figure 5:
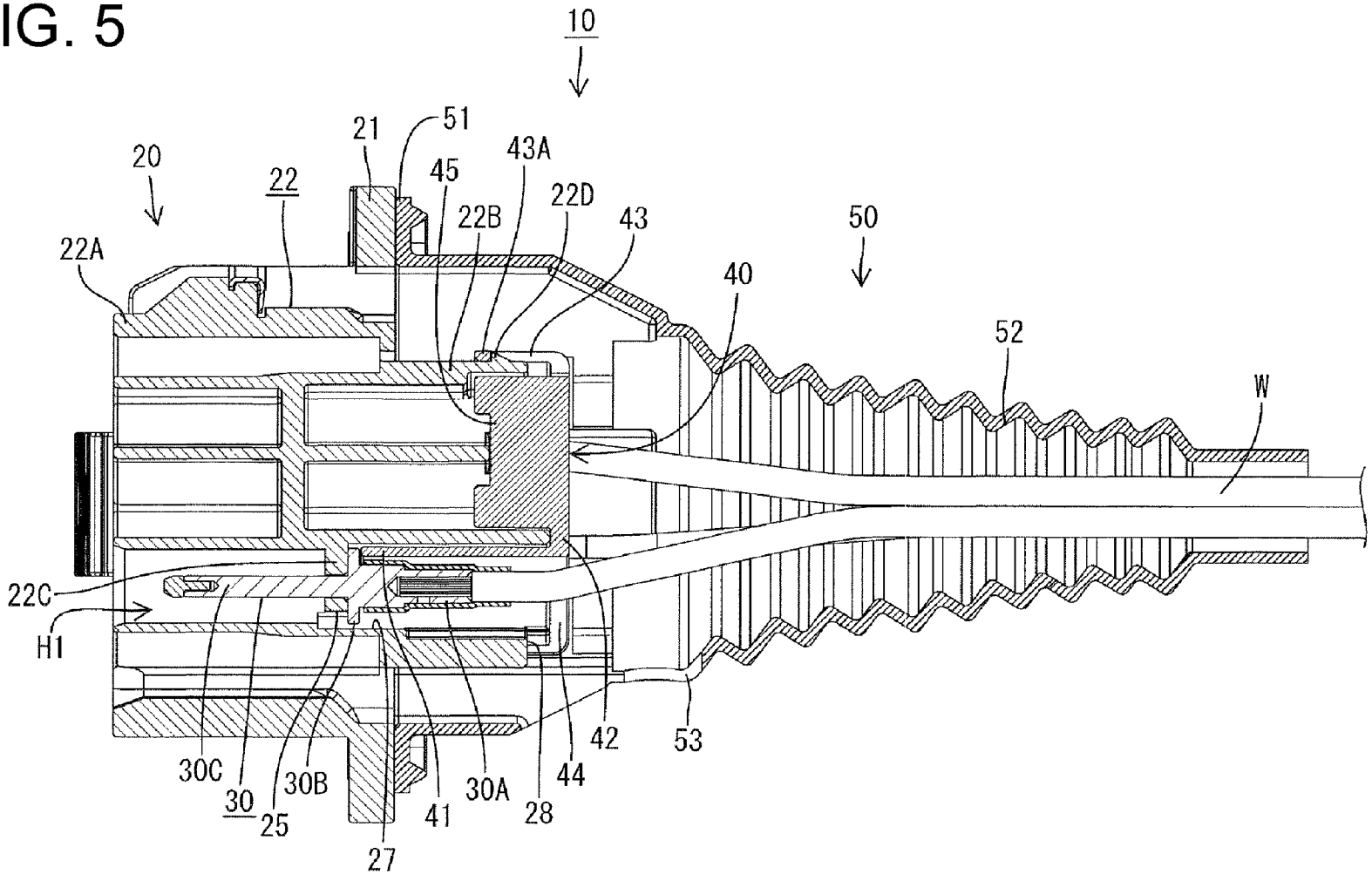
FIG. 5 is a section along A-A in FIG. 4.
Figure 6:
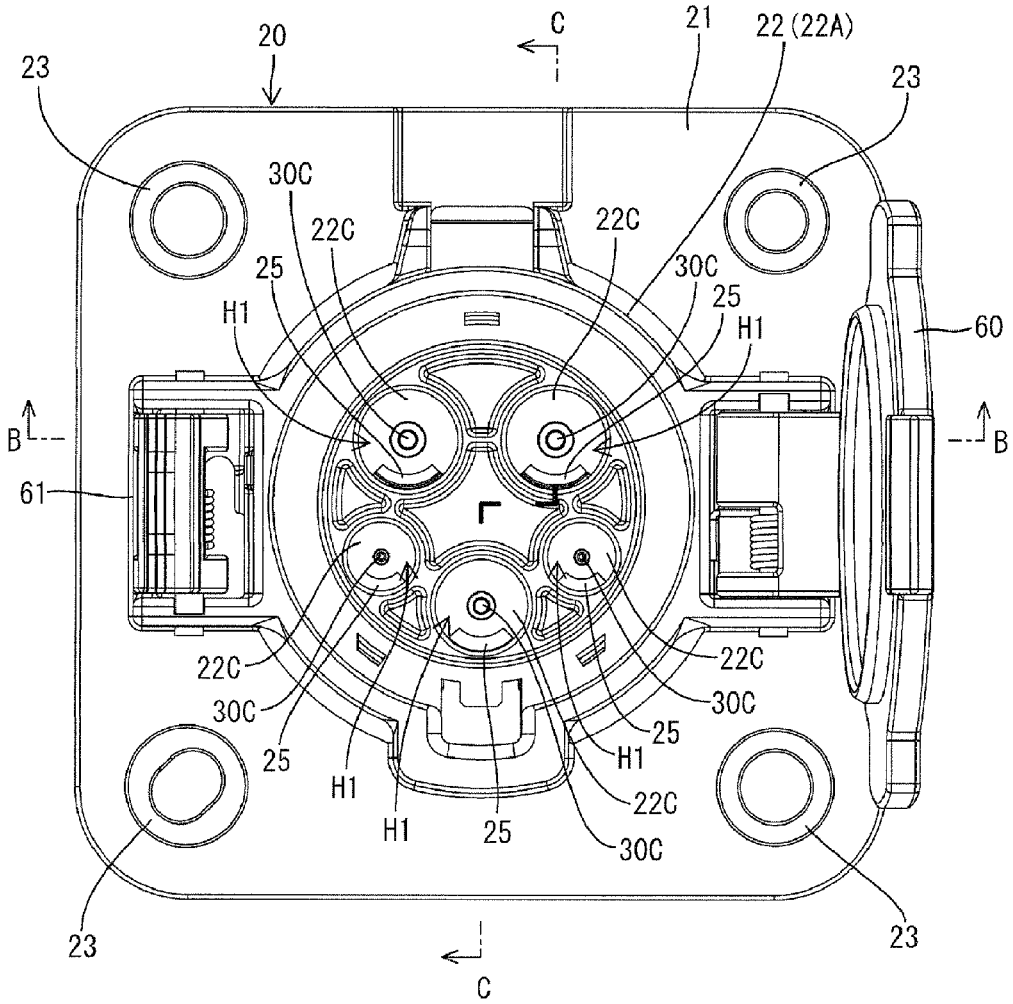
FIG. 6 is a front view of a housing in which vehicle-side terminals are mounted in a terminal accommodating portion.
Figure 7:
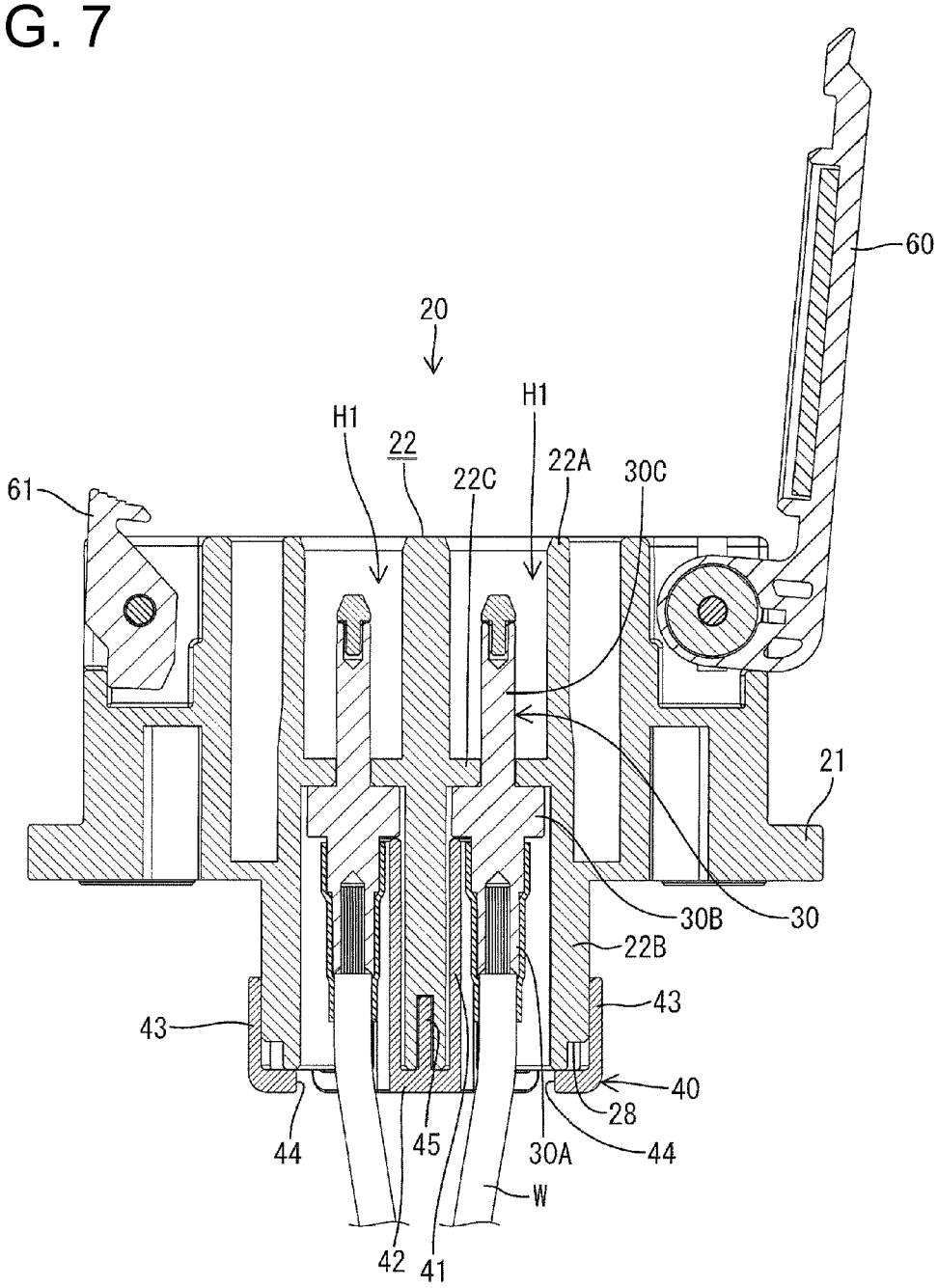
FIG. 7 is a section along B-B in FIG. 6.
Figure 8:
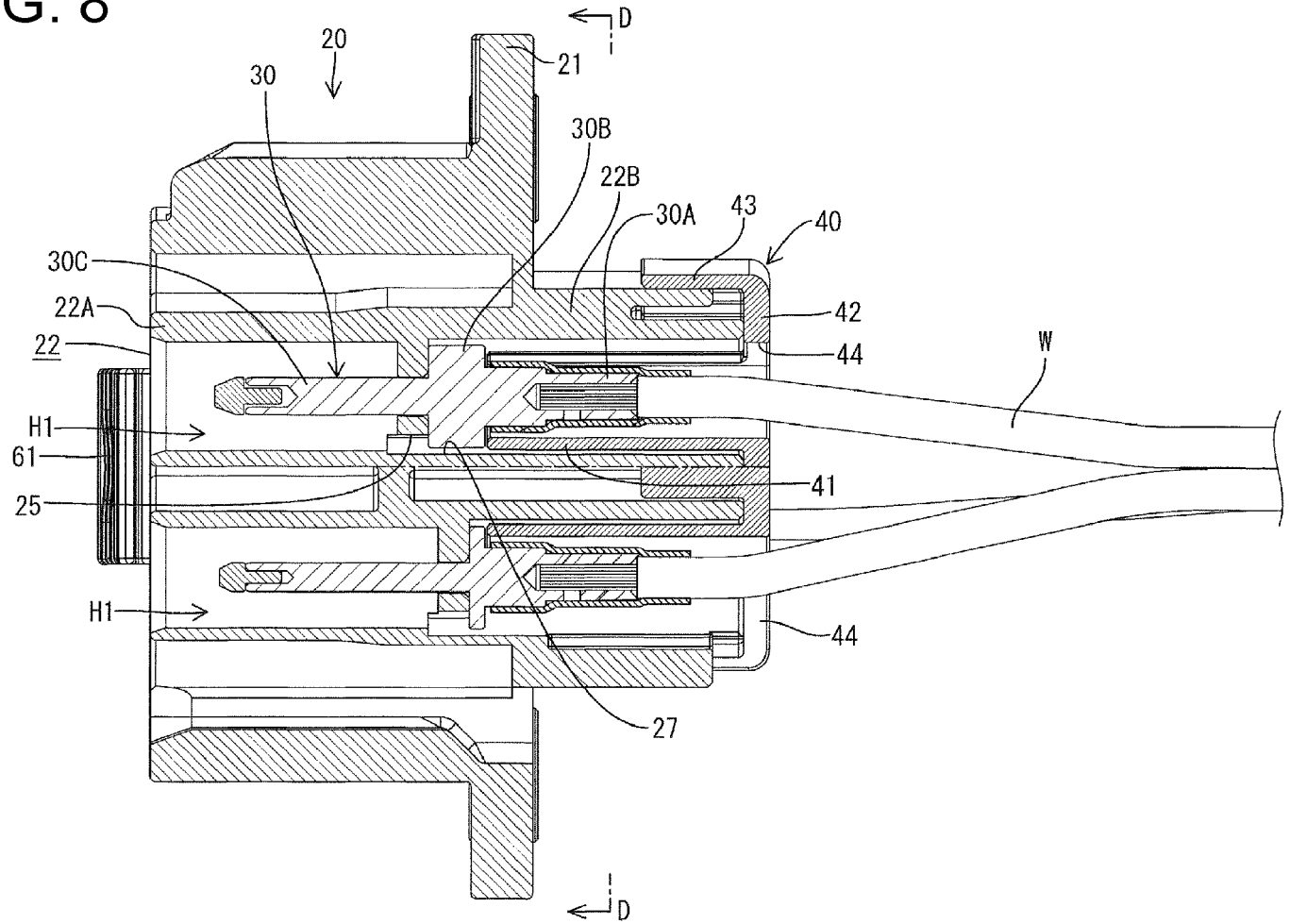
FIG. 8 is a section along C-C in FIG. 4.
Figure 16:
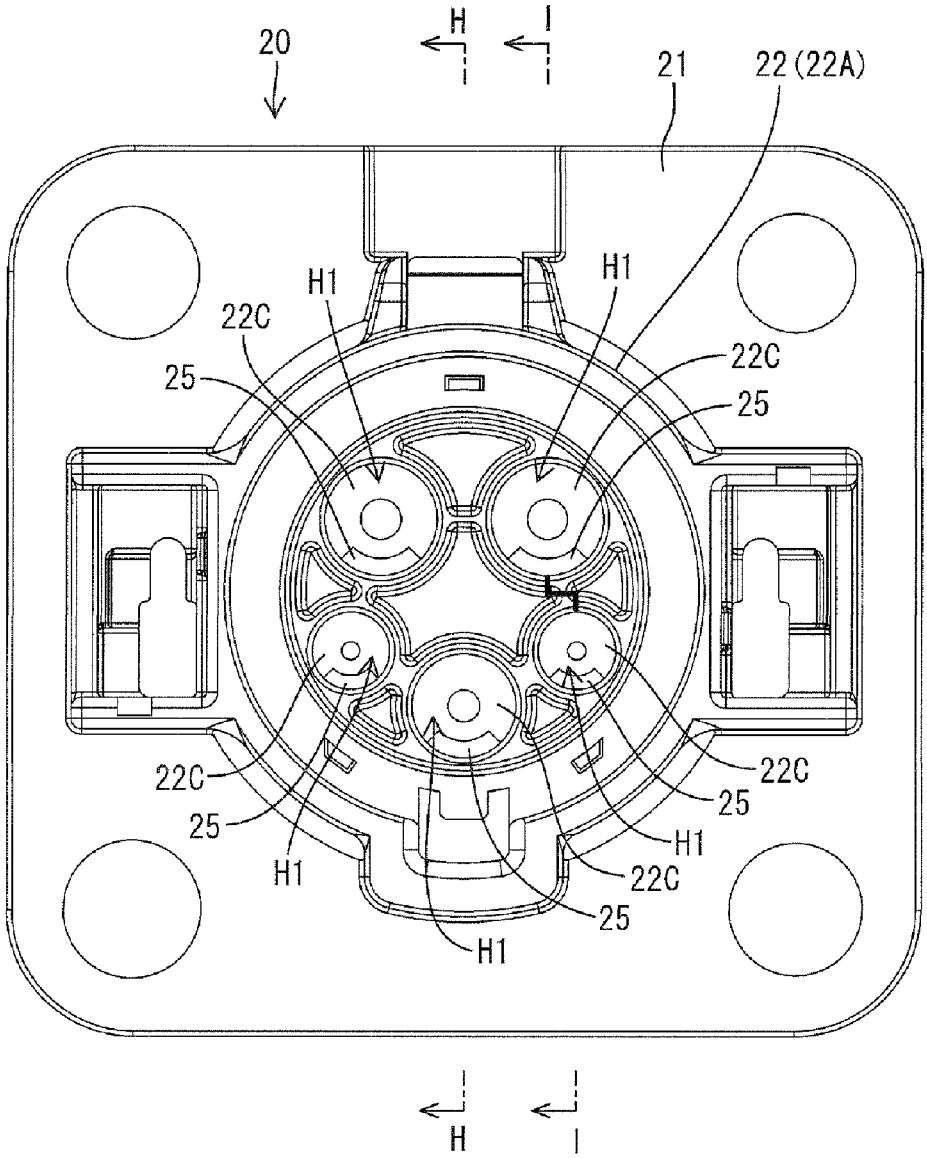
FIG. 16 is a front view of the housing.
Figure 18:
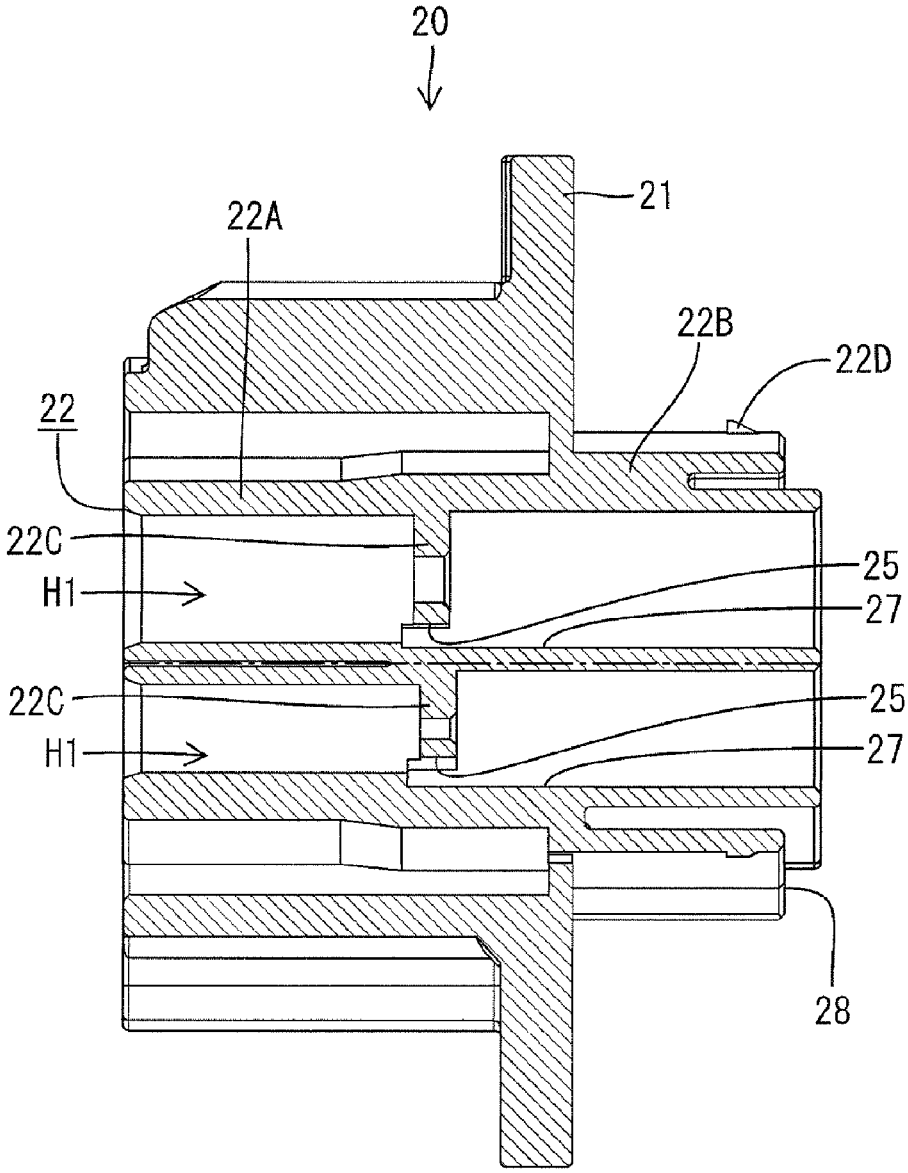
FIG. 18 is a section along I-I in FIG. 16.

As shown in FIGS. 17 and 18, the terminal accommodating holes H1 are partitioned into front and rear sections by partition walls 22C formed in the terminal accommodating portion 22. The partition walls 22C are formed with terminal insertion holes through which the terminal connecting portions 30C are insertable. As shown in FIG. 16, second drainage holes 25 are formed below the terminal insertion holes in the partition walls 22C to penetrate in forward and backward directions. Accordingly, when the vehicle-side terminal 30 is inserted into the terminal accommodating hole H1 from behind, the terminal connecting portion 30C passes through the terminal insertion hole, projects forward from the partition wall 22C and is stopped at its front position by the contact of the flange 30B with the rear surface of the partition wall 22C as shown in FIG. 5.

Figure 20:
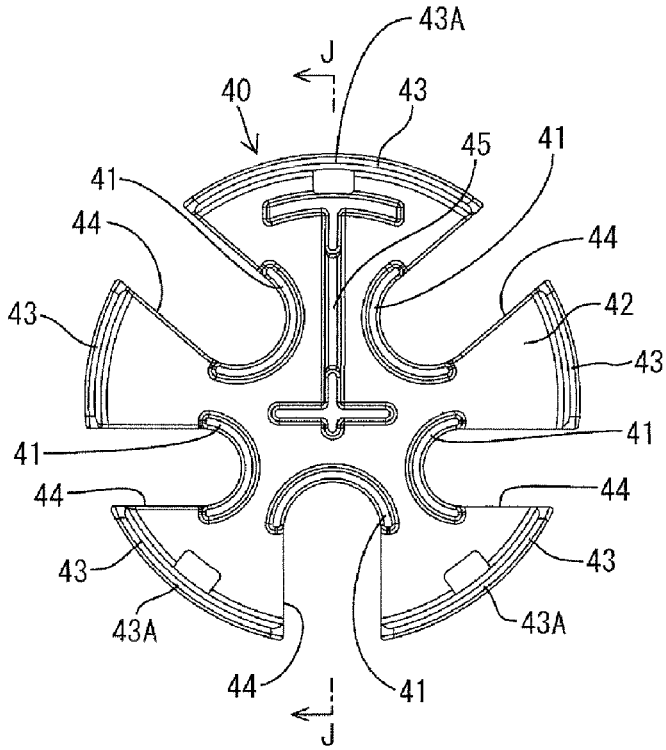
FIG. 20 is a front view of the retainer.
Figure 22:
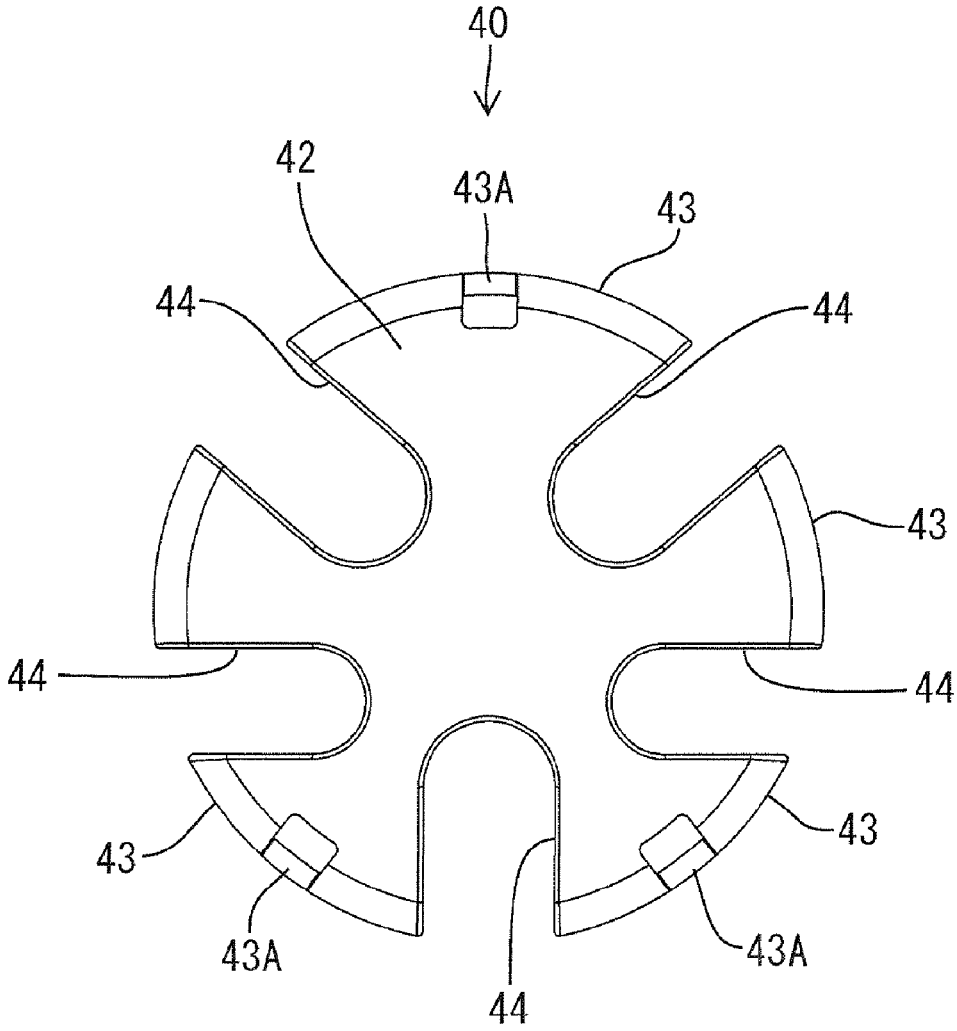
FIG. 22 is a rear view of the retainer.

The retainer 40 is made e.g. of synthetic resin and to be mounted into the housing 20 from behind as shown in FIG. 1. As shown in FIG. 20, the retainer 40 includes a base 42 with substantially U-shaped retaining pieces 41. Mounting pieces 43 project from the outer peripheral edge of the base 42 and are mounted on the outer periphery of the rear projection 22B. The retaining pieces 41 are inserted respectively into the corresponding terminal accommodating holes H1 by mounting the retainer 40 into the housing 20. Further, the respective mounting pieces 43 are arranged intermittently along the outer peripheral surface of the base 42, as shown in FIG. 22.

Figure 9:
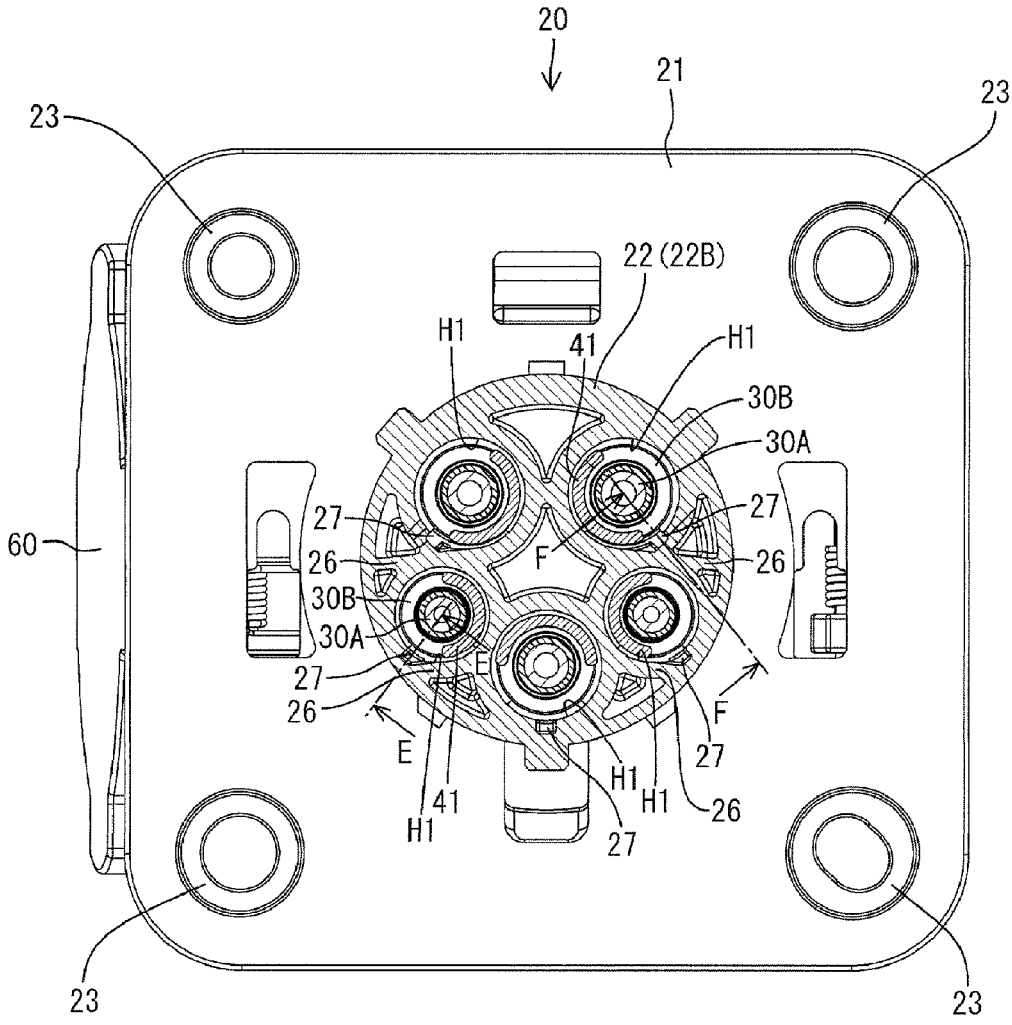
FIG. 9 is a section along D-D in FIG. 8.
Figure 13:
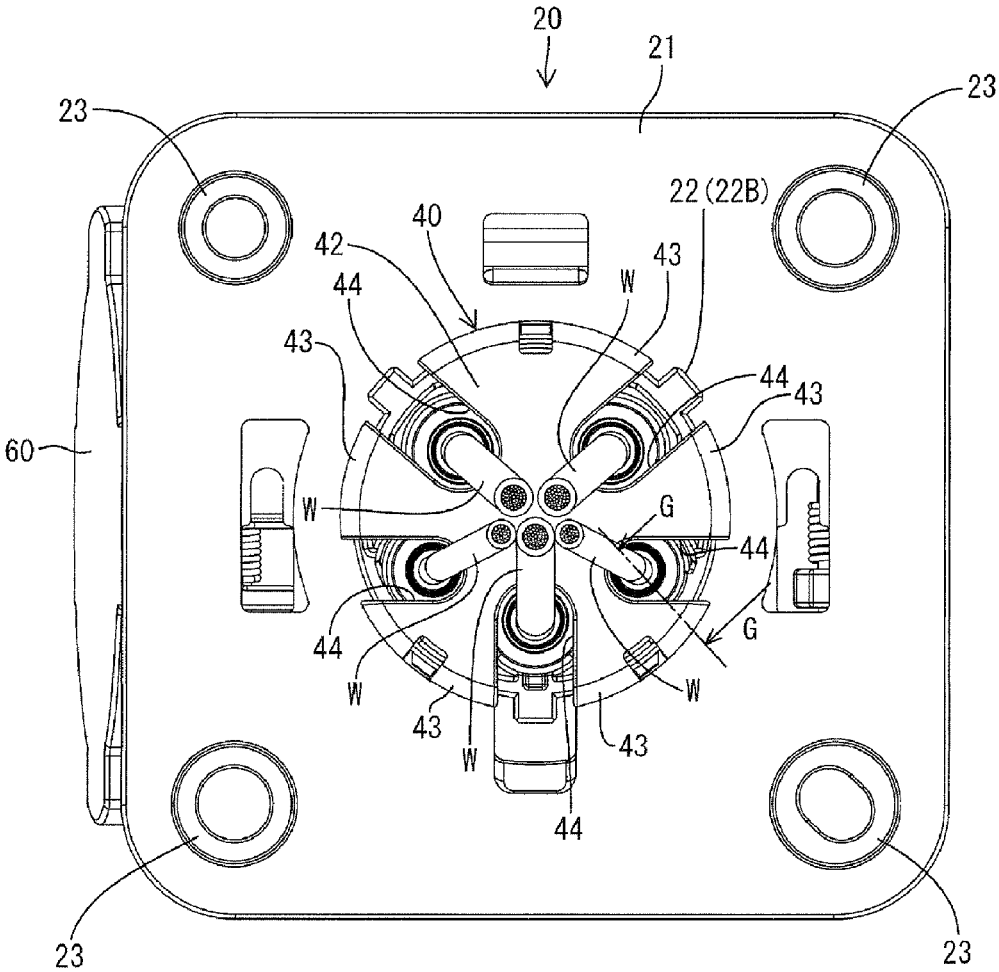
FIG. 13 is a rear view of the housing showing a retainer mounted state.

Cutout holes 44 are formed in a range from the base 42 to the mounting pieces 43. The cutout holes 44 allow the introduction of the wires W to the base 42, with the wires W arranged radially inward of the cutout holes 44, as shown in FIG. 13. The formation of the cutout holes 44 in the mounting pieces 43 in this way avoids the need to insert the wires W into the cutout holes 44 beforehand and the retainer 40 can be mounted into the rear projection 22B with a plurality of wires W pulled out backward from the rear projection 22B. As shown in FIG. 20, the retaining pieces 41 are arranged only in parts left as the base 42 is cut radially, i.e. in radially inner ends of the cutout holes 44. Note that the respective retaining pieces 41 are arranged along the inner peripheral surfaces of the corresponding terminal accommodating holes H1, as shown in FIG. 9.

Left and right retaining pieces 41 are arranged in an upper level and substantially correspond to the terminal accommodating holes H1 into which the power terminals 31 are to be inserted. A relatively large current flows in the power terminals 31. Thus, a partition wall 45 is provided between the two retaining pieces 41 in the upper level to improve isolation and to prevent a short circuit between the two power terminals 31. The partition wall 45 projects from the base 42 similar to the retaining pieces 41 and is inserted between the two terminal accommodating holes H1 corresponding to the two power terminals 31. Accordingly, water cannot penetrate between the two terminal accommodating holes H1 in a manner that would cause a short circuit of the two power terminals 31. Two additional retaining pieces 41 are arranged in a level that has to the two terminal accommodating holes H1 that receive the two signal terminals 32. A further retaining piece 41 is in the center position of a lower level and corresponds to the terminal accommodating hole H1 that receives the ground terminal 33.

Figure 21:
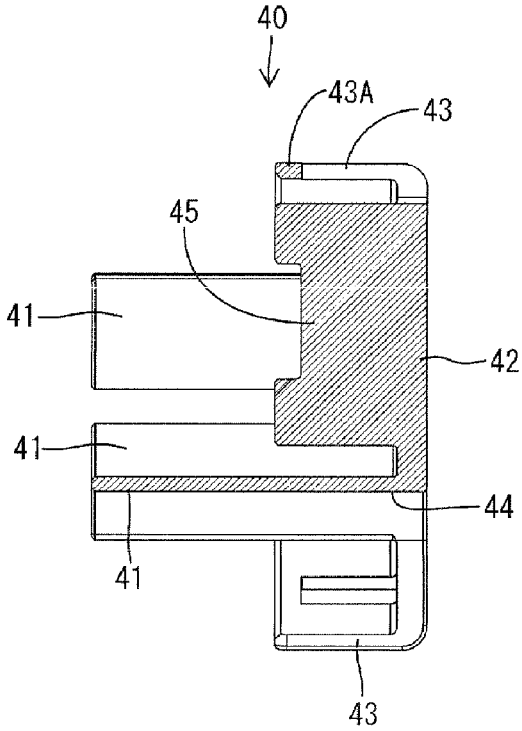
FIG. 21 is a section along J-J in FIG. 20.

As shown in FIG. 21, locks 43A are formed at projecting ends of the mounting pieces 43. The locks 43A are displaceable in a surface direction of the base 42 with ends toward the base 42 as supports. On the other hand, engaging portions 22D are formed on the outer periphery of the rear projection 22B, as shown in FIG. 18. The locks 43A engage the engaging portions 22D in forward and backward directions when the retainer 40 is mounted into the rear projection 22B, as shown in FIG. 5, to hold the mounting pieces 43 in a mounted state on the outer periphery of the rear projection 22B. Further, as shown in FIG. 5, the retaining pieces 41 contact the respective flanges 30B from behind to hold the vehicle-side terminals 30 in the terminal accommodating holes H1 so as not to come out backward.

Figure 23:
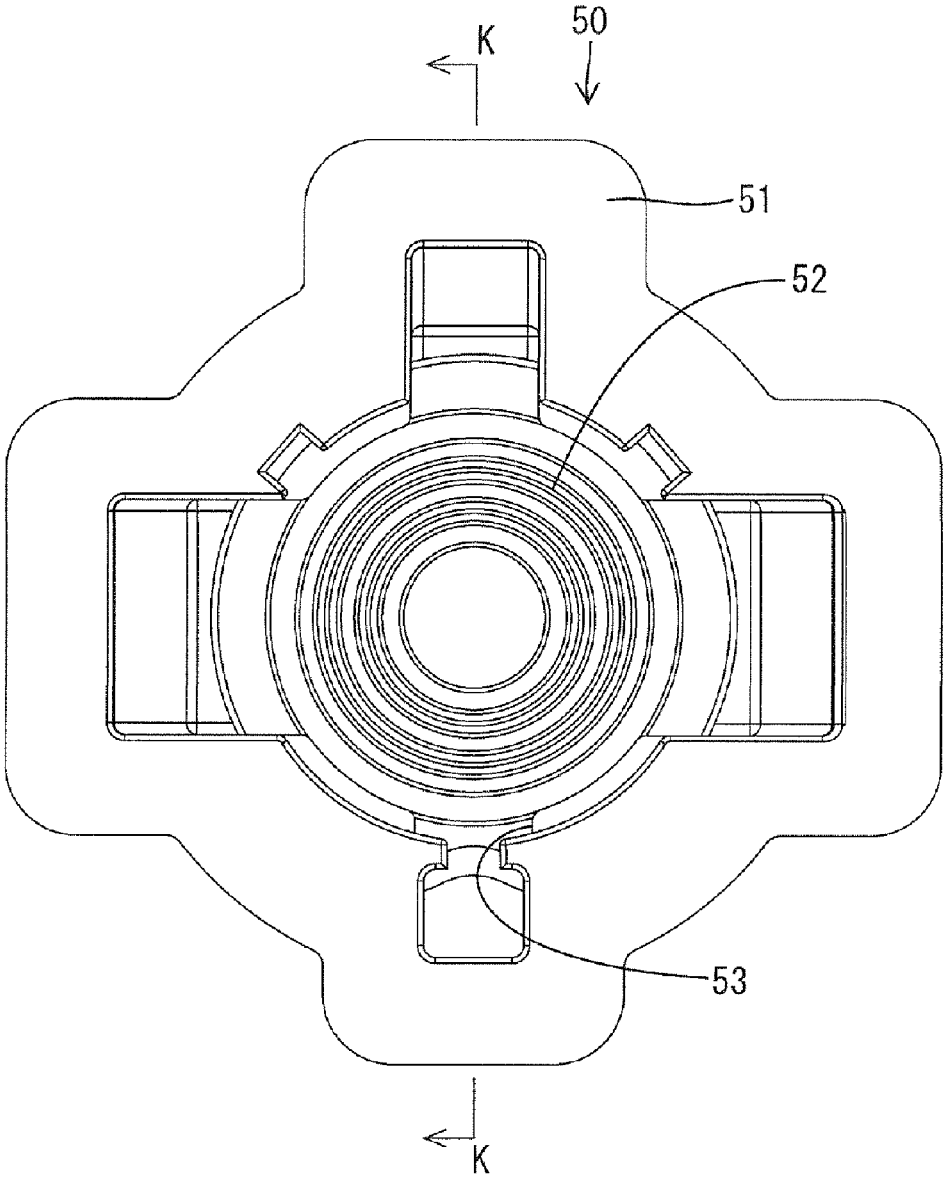
FIG. 23 is a front view of a grommet.
Figure 24:
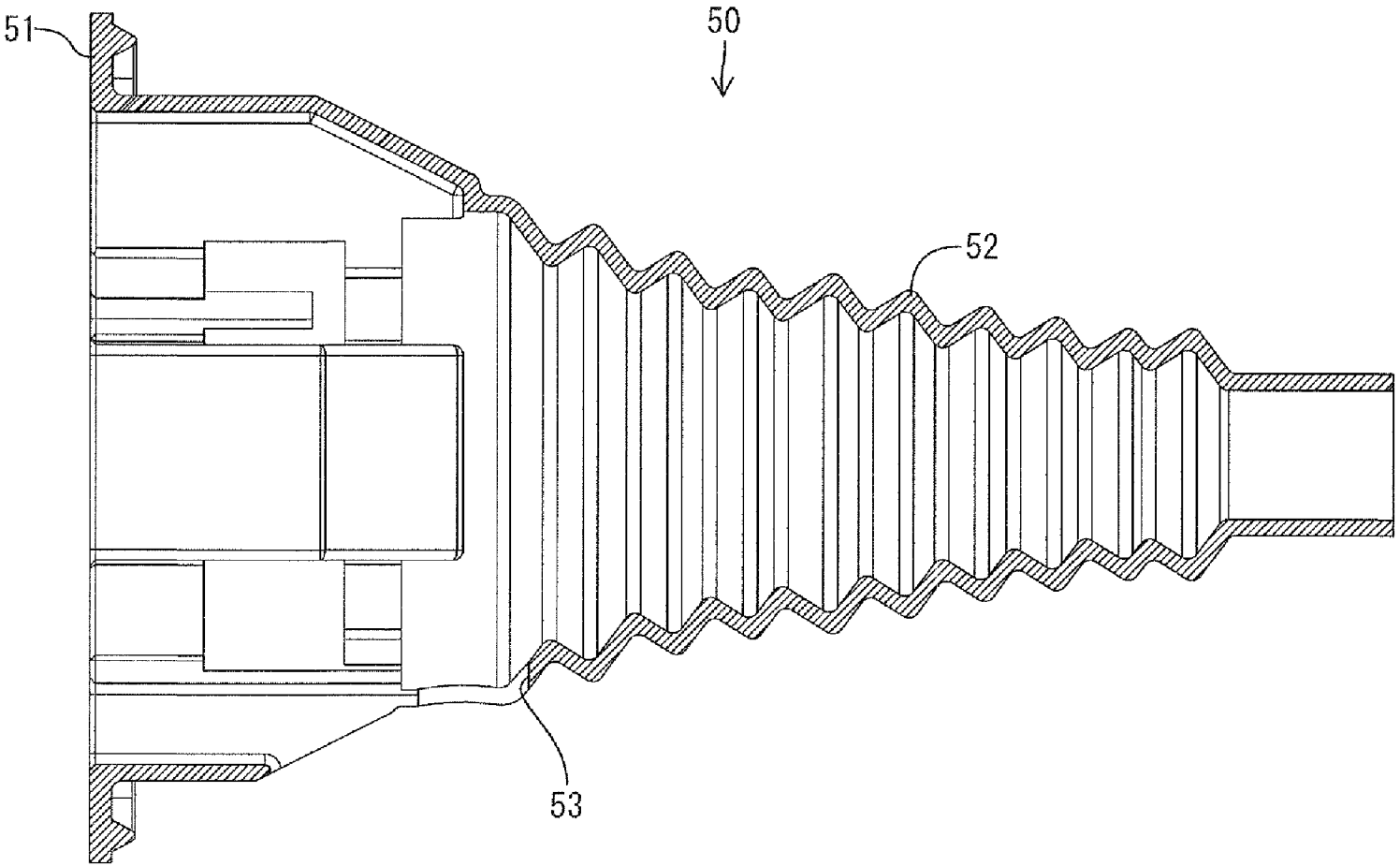
FIG. 24 is a section along K-K in FIG. 23.

The grommet 50 is made of a resilient material, such as rubber, and includes at least one mountable portion 51 that can come into surface contact with the mounting portion 21 of the housing 20 from behind. A wire inserting portion 52 forms an opening in the mountable portion 51 and extends back, as shown in FIG. 23. The mountable portion 51 is to be held in surface contact with the mounting portion 21 by a known fixing means. The wire inserting portion 52 is substantially bellows-like and can deflect in a direction in which the wires W are to be deflected. As shown in FIG. 24, at least one escaping hole 53 penetrates through the lower surface of the wire inserting portion 52. The exterior of the wire inserting portion 52 communicates with the outside of the vehicle. Thus, water discharged into the wire inserting portion 52 from the outer periphery of the terminal accommodating portion 22 can be discharged to the outside through the escaping hole 53.

Figure 19:
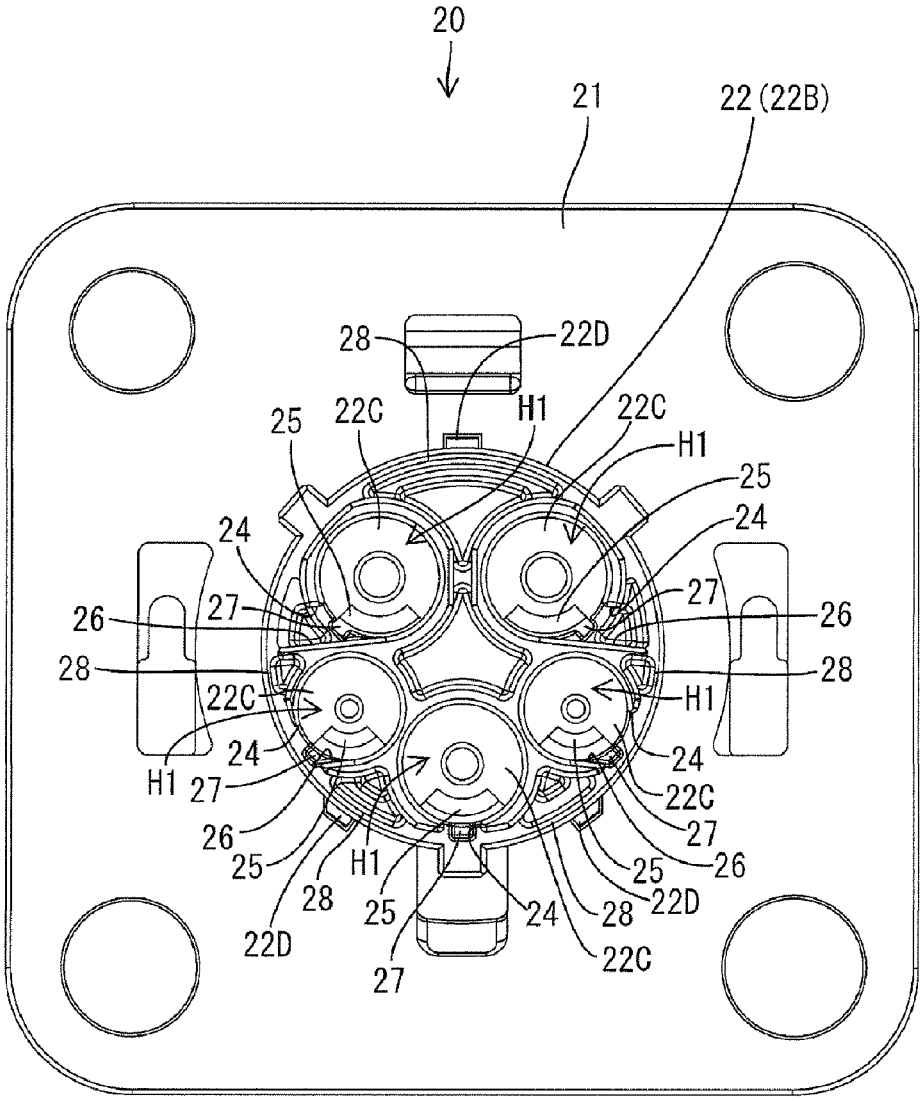
FIG. 19 is a rear view of the housing.

First drains 24 are formed through inner walls of the terminal accommodating holes H1 at positions aligned with the rear projection 22B of the terminal accommodating portion 22 when the retainer 40 is mounted into the rear projection 22B, as shown in FIG. 19. The first drains 24 are formed in peripheral parts of the inner walls of the terminal accommodating holes H1 distant from the partition wall 45 that is inserted between the two terminal accommodating holes H1 in the upper level. In other words, the first drains 24 are formed in the peripheral parts of the inner walls of the terminal accommodating holes H1 close to the outer periphery of the rear projection 22B.

Specifically, the first drains 24 in the terminal accommodating holes H1 in the upper and middle levels in FIG. 19 are formed in a range from bottom ends of the inner walls of the terminal accommodating holes H1 to positions close to the outer periphery of the rear projection 22B and are open laterally. Further, the first drain 24 in the terminal accommodating hole H1 in the lower level in FIG. 19 is formed by cutting out a bottom end portion of the inner wall of the terminal accommodating hole H1 and opens down.

A liquid or water guide 26 is connected to the bottom end of each of the first drains 24 in the upper and middle levels in FIG. 19. This water guide 26 is a downwardly sloped flat plate connected to the outer periphery of the rear projection 22B. In other words, the water guide 26 slopes down from the lower edge of the first drain 24 and connected to the outer periphery of the rear projection 22B. Thus, water can be discharged from the first drain 24 to the outer periphery of the rear projection 22B along the water guide 26.

Figure 10:
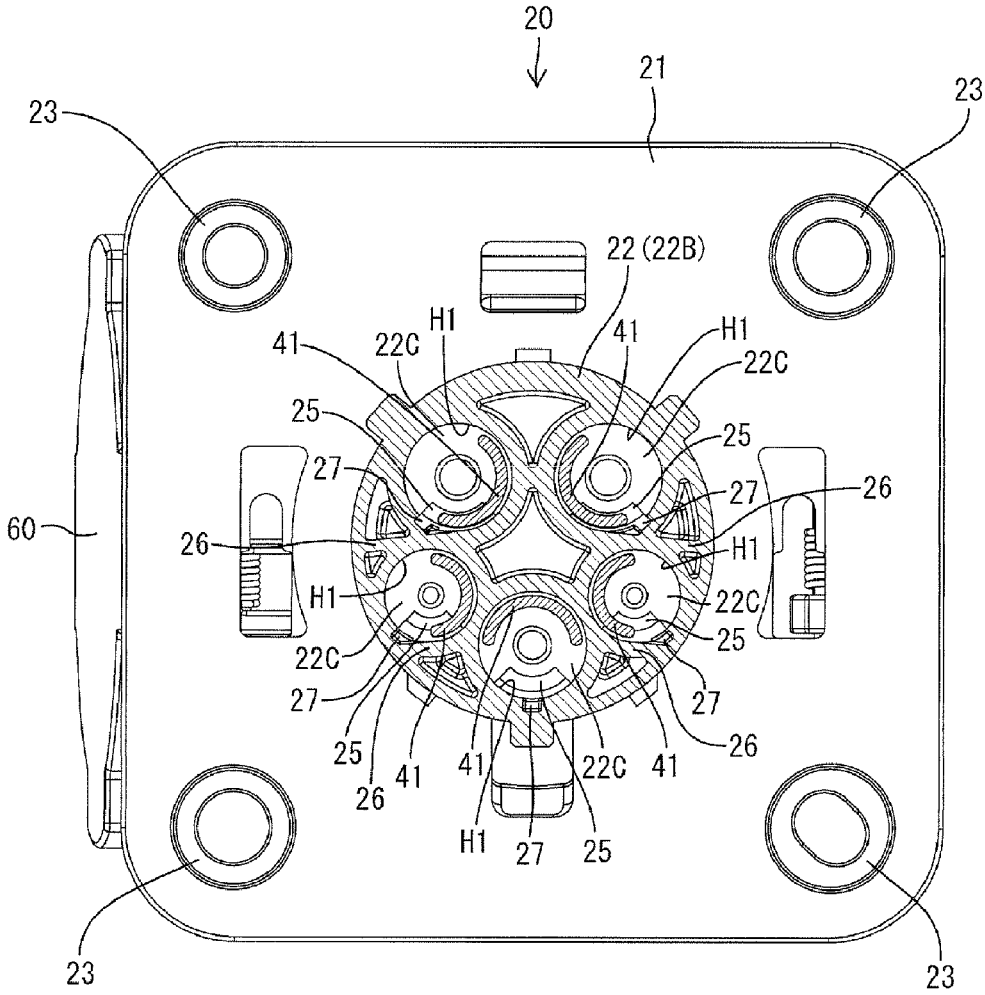
FIG. 10 is similar to FIG. 9, but no terminal fittings in FIG. 9 are mounted.
Figure 11:
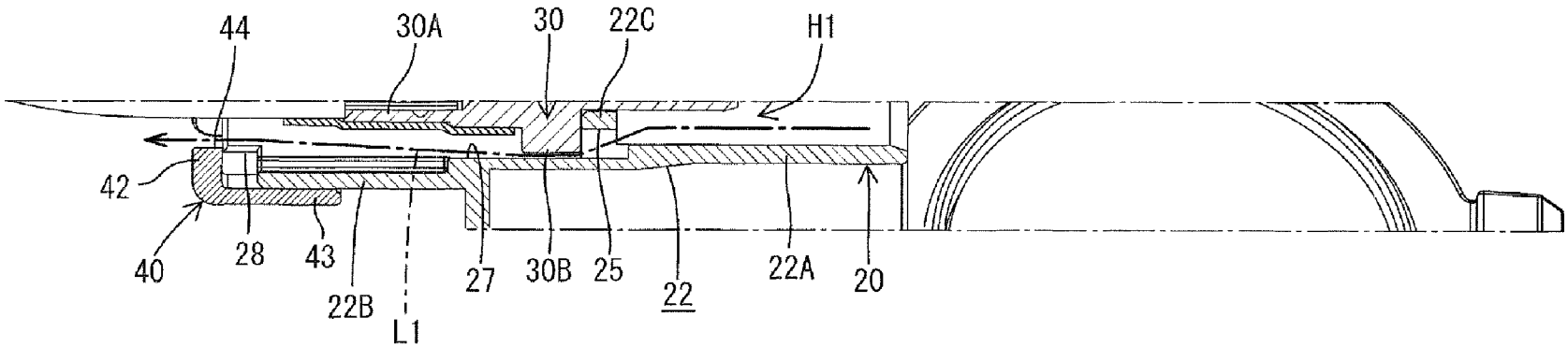
FIG. 11 is a section along E-E in FIG. 9.
Figure 12:
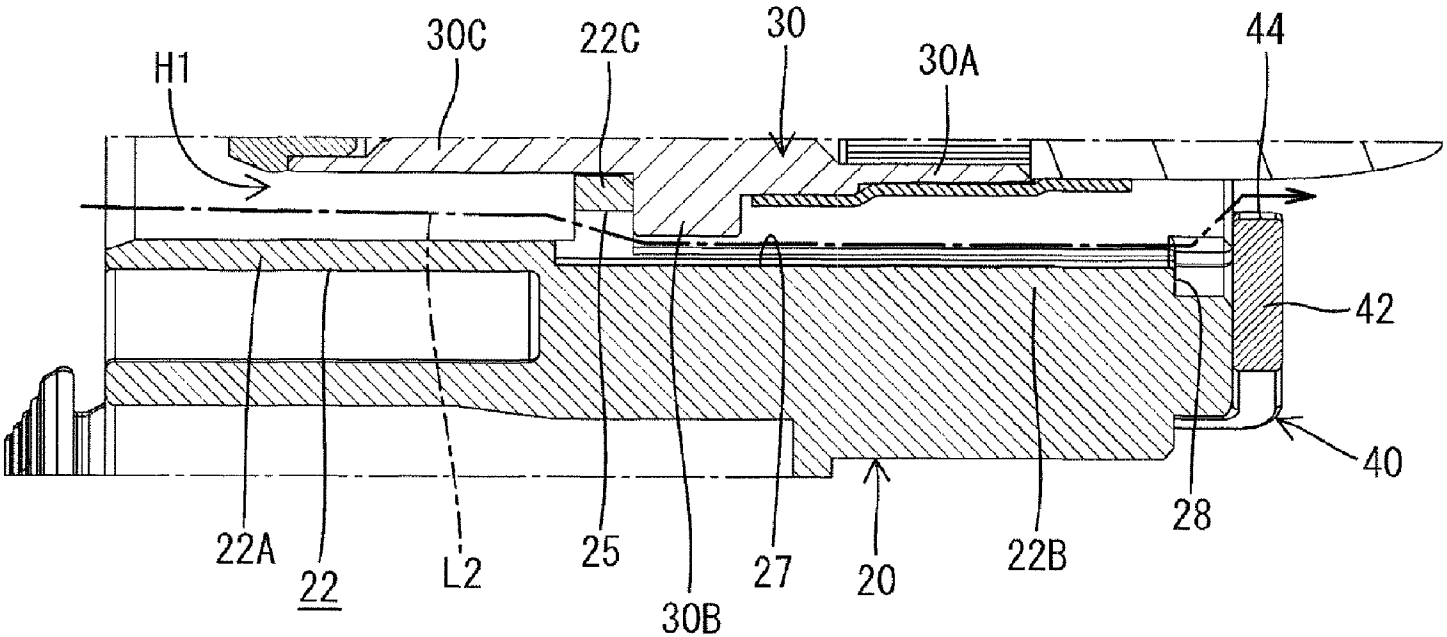
FIG. 12 is a section along F-F in FIG. 9.
Figure 15:
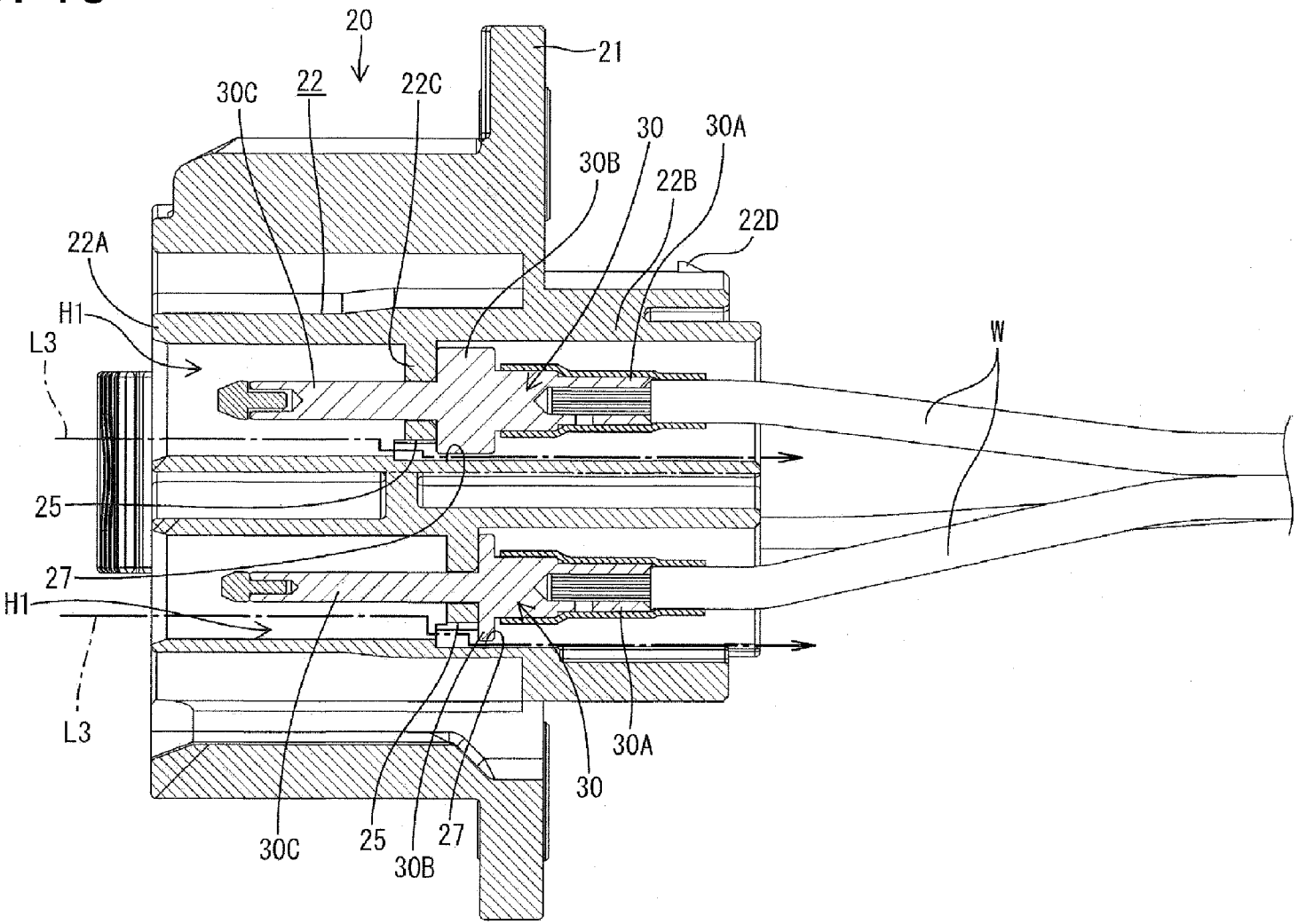
FIG. 15 is a view showing a state where the retainer in FIG. 8 is not mounted.

The lower side of the peripheral wall of each terminal accommodating hole H1 particularly is recessed to form a bypass groove 27, as shown in FIG. 9. The bypass grooves 27 project radially outward of the flanges 30B accommodated in the terminal accommodating holes H1. The bypass grooves 27 are formed in area overlapping the second drains 25 in radial directions of the terminal accommodating holes H1, as shown in FIG. 10. Further, the bypass grooves 27 do not overlap the retaining pieces 41 in radial directions of the terminal accommodating holes H1, shown in FIG. 9. In addition, the bypass grooves 27 extend substantially in forward and backward directions to communicate with the second drains 25 and the cutout holes 44, for example, as shown in FIG. 11. Thus, water in the front projection 22A can pass in the bypass grooves 27 from the second drains 25 while bypassing the flanges 30B and can be discharged into the grommet 50 as shown by a dashed-dotted line L1 of FIG. 11, a dashed-dotted line L2 of FIG. 12 and/or a dashed-dotted line L3 of FIG. 15.

Figure 14:
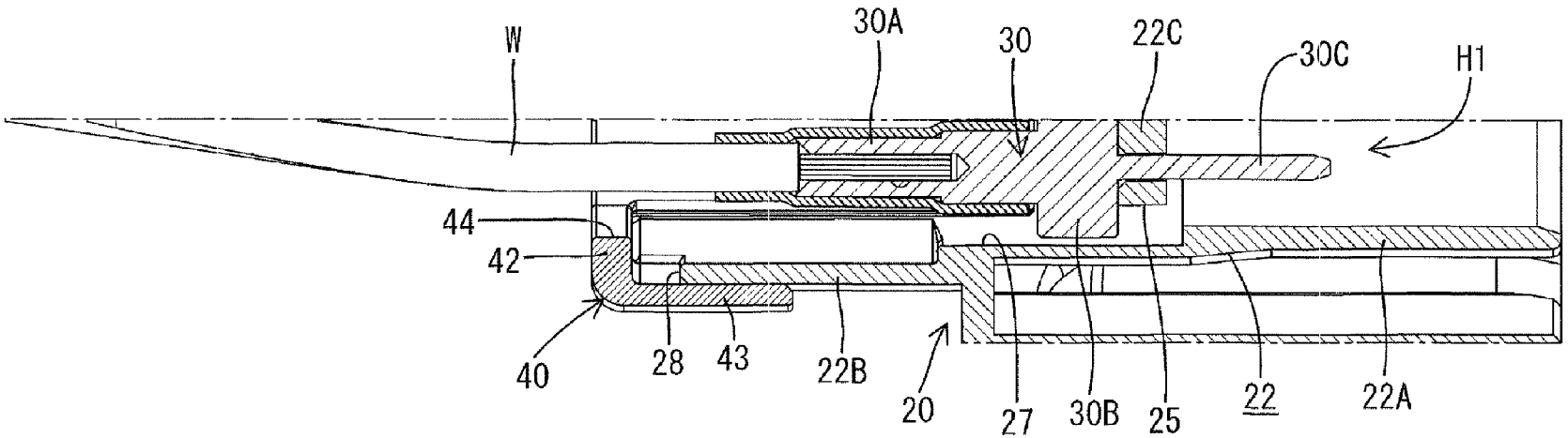
FIG. 14 is a section along G-G in FIG. 13.

As shown in FIG. 14, the rear end of the outer periphery of the rear projection 22B is cut in a circumferential direction to form a stepped portion 28. A clearance is formed between the stepped portion 28 and the retainer 40 to allow passage of liquid or water. Thus, water discharged from the first drains 24 to the outer periphery of the rear projection 22B via the water guides 26 does not stay in the retainer 40 and can be discharged into the grommet 50 through the above-described clearance.

Upon assembling the vehicle-side connector 10, the wire connecting portions 30A of the vehicle-side terminals 30 are crimped and connected to ends of the wires W in a state of FIG. 1 and the shrinkable tubes 34 are mounted in the ranges from the wire connecting portions 30A to the coatings of the wires W. The vehicle-side terminals 30 then are inserted into the terminal accommodating holes H1 from behind so that the terminal connecting portions 30C of the vehicle-side terminals 30 pass through the partition walls 22C and into the front projection 22A so that the flanges 30B contact the rear surfaces of the partition walls 22C to hold the vehicle-side terminals 30 at their front end positions.

The retainer 40 then is mounted to the rear projection 22B from behind. Upon mounting the retainer 40, the respective wires W are accommodated in the cutout holes 44 beforehand and the one or more retaining pieces 41 are inserted into the terminal accommodating holes H1 from behind to contact the rear surfaces of the flanges 30B. Simultaneously, the locks 43A of the mounting pieces 43 engaged the engaging portions 22D of the rear projection 22B to hold the mounting pieces 43 in the mounted state on the outer periphery of the rear projection 22B. Thus, the retainer 40 is fixed to the rear projection 22B and the vehicle-side terminals 30 are held and retained in the terminal accommodating holes H1. Subsequently, the grommet 50 is fixed to the housing 20 and the vehicle-side connector 10 is fixed (particularly bolted) to the body of the vehicle when the assembling of the vehicle-side connector 10 is completed.

Upon charging the battery of the vehicle, the fluid- or water-stop cap 60 is opened from the closed position to the open position and the charging connector is connected to the housing 20. At this time, air in the terminal accommodating holes H1 escapes into the interior of the grommet 50 through the second drains 25, the bypass grooves 27, the cutout holes 44 and the like. Therefore a small connecting force is sufficient. In an open state of the water-stop cap 60, rainwater and/or conductive liquid at the time of washing the vehicle may, for example, splash on the vehicle-side connector 10. In such cases, the liquid (rainwater and the like) having splashed on the vehicle-side connector 10 needs to be discharged quickly to the outside of the vehicle.

Accordingly, liquid or water retained in the terminal accommodating holes H1 of the front projection 22A is discharged into the terminal accommodating holes H1 of the rear projection 22B through the second drains 25 and the bypass grooves 27. Thereafter, the water in the terminal accommodating holes H1 is discharged into the grommet 50 mainly via two discharge paths. The first discharge path passes the first drains 24, the water guides 26, the stepped portion 28 and the like. The second discharge path discharges water back from the cutout holes 44. In this way, the water in the terminal accommodating holes H1 is discharged quickly into the grommet 50 and discharged to the outside of the vehicle through the escaping hole 53.

As described above, in this embodiment, the first drains 24 are formed in the inner wall of the rear projection 22B and the water guides 26 are connected to the lower edges of the first drains 24. Thus, the water in the terminal accommodating holes H1 can be discharged into the grommet 50. Alternatively, the water in the terminal accommodating holes H1 can pass in the bypass grooves 17 from the second drains 25 while bypassing the flanges 30B, and discharged into the grommet 50 through the cutout holes 44 from the bypass grooves 27. Further, the water discharged to the outer periphery of the rear projection 22B also can be discharged into the grommet 50 through the clearance formed between the stepped portion 28 and the retainer 40. In this way, a short circuit between the two power terminals 31 can be prevented by inserting the partition wall 45 between the two terminal accommodating holes H1 in the upper level, the water in the terminal accommodating holes H1 can be discharged efficiently into the grommet 50, and the water in the grommet 50 can be discharged to the outside of the vehicle through the escaping hole 53.

The invention is not limited to the above described and illustrated embodiment. For example, the following embodiments are also included in the technical scope of the present invention as defined by the claims.

Although the first drains are formed in the peripheral wall of the rear projection in the above embodiment, they may be formed in the peripheral wall of the front projection. In this case, the grommet may be so mounted as to cover the front projection.

Although the vehicle-side terminals are held at their front end positions by providing the partition walls in the above embodiment, it is not always necessary to provide the partition walls. For example, if the vehicle-side terminals are female terminal fittings, front walls with which front end portions of the vehicle-side terminals contact may be provided at the front ends of the terminal accommodating holes and the vehicle-side terminals may be held at their front end positions by these front walls.

Although the bypass grooves are formed only in the rear projection in the above embodiment, the bypass grooves may be formed in the entire area from the front projection to the rear projection according to the invention.

Although the clearance is formed by providing the stepped portion at the rear edge of the outer periphery of the rear projection in the above embodiment, a clearance may be additionally or alternatively formed by forming a recessed groove in the base portion of the retainer according to the invention.

What is claimed is:

1. A vehicle-side connector to be connected to a charging connector at the time of charging, comprising:

a housing;

a terminal accommodating portion provided in the housing and including a plurality of terminal accommodating holes;

terminal fittings accommodated in the terminal accommodating holes;

at least one partition wall provided between the terminal accommodating holes that are adjacent to one another;

at least one drainage hole formed at peripheral parts of inner walls of the terminal accommodating holes distant from the partition wall; and at least one water guide sloped down from peripheral edges of the drainage holes toward an outer periphery of the terminal accommodating portion.

2. The vehicle-side connector of claim 1, wherein the at least one partition wall is provided on a retainer mounted on the outer periphery of the terminal accommodating portion.

3. The vehicle-side connector of claim 1, wherein the terminal accommodating portion includes a front projection projecting forward of the housing, a rear projection projecting backward of the housing, and partition walls at least partly partitioning the terminal accommodating holes into front and rear sections.

4. The vehicle-side connector of claim 3, wherein the at least one drainage hole is a first drainage hole, the vehicle-side connector further comprising at least one second drainage hole penetrating through the partition walls in substantially forward and backward directions.

5. The vehicle-side connector of claim 4, wherein the first drainage hole is formed in a peripheral wall of the rear projection.

6. The vehicle-side connector of claim 5, wherein each terminal fitting includes at least one flange contacting a rear surface of the partition wall.

7. The vehicle-side connector of claim 6, wherein at least one bypass groove if formed in an inner wall of each terminal accommodating hole in the rear projection for discharging water backward from the second drainage hole while bypassing the flange.

8. The vehicle-side connector of claim 7, wherein the retainer includes mounting pieces mounted on the outer periphery of the rear projection.

9. The vehicle-side connector of claim 8, wherein at least one clearance is formed substantially in a circumferential direction between the mounting pieces and the outer periphery of the rear projection for allowing passage of water.

10. The vehicle-side connector of claim 7, wherein the bypass groove is formed in an area at least partly overlapping the at least one second drainage hole in substantially radial directions of the terminal accommodating holes.

11. The vehicle-side connector of claim 2, wherein the retainer has a base and at least one mounting piece mounted on the terminal accommodating portion.

12. The vehicle-side connector of claim 11, wherein at least one cutout hole is formed in a range from the base to the mounting pieces to allow an introduction of wires connected to the terminal fittings to the base, and the wires are arranged radially inwardly of the cutout holes.

13. The vehicle-side connector of claim 11, wherein mounting pieces are arranged intermittently along an outer peripheral surface of the base.

* * * * *